US007416339B2

(12) United States Patent
Plourde et al.

(10) Patent No.: US 7,416,339 B2
(45) Date of Patent: Aug. 26, 2008

(54) SLIDER FOR SINGLE HAND OPERATION

(75) Inventors: Eric P. Plourde, Homewood, IL (US); John H. Schneider, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 527 days.

(21) Appl. No.: 10/996,480

(22) Filed: Nov. 24, 2004

(65) Prior Publication Data

US 2006/0110075 A1 May 25, 2006

(51) Int. Cl.
*B65D 33/16* (2006.01)
*A44B 1/04* (2006.01)

(52) U.S. Cl. ..... 383/64; 24/399; 24/415

(58) Field of Classification Search ..... 383/64, 383/97; 24/399–400, 415–431; 294/3.6
See application file for complete search history.

(56) References Cited

U.S. PATENT DOCUMENTS

| | | | | | |
|---|---|---|---|---|---|
| 1,703,712 | A * | 2/1929 | Aud | 383/64 |
| 2,306,488 | A * | 12/1942 | Morner | 441/103 |
| 5,081,747 | A * | 1/1992 | Takizawa et al. | 24/415 |
| 5,722,128 | A * | 3/1998 | Toney et al. | 24/400 |
| 6,026,546 | A * | 2/2000 | Lund et al. | 24/431 |
| 6,592,260 | B1 * | 7/2003 | Randall et al. | 383/64 |

* cited by examiner

*Primary Examiner*—Jes F Pascua
(74) *Attorney, Agent, or Firm*—Day Pitney LLP

(57) ABSTRACT

A slider for use with interlocking profiles in a reclosable plastic bag is disclosed. The slider includes a rotary device which allows the user to hold the reclosable plastic bag and operate the slider with a single hand. The rotary device can be a thumbwheel which is journaled for rotation about an axis in the side or top of the slider, and can also be a flexible or elastic band which passes through and is retained by slots formed in the slider.

9 Claims, 2 Drawing Sheets

SLIDER FOR SINGLE HAND OPERATION

BACKGROUND OF THE INVENTION

1. Field of the Invention

The present invention relates to a slider for a reclosable bag, wherein the slider includes a thumbwheel or similar rotary device in order to move the slider along the zipper at the mouth of the reclosable bag. This permits the user to open or close the slider while using a single hand.

2. Description of the Prior Art

In the prior art of reclosable bags, it is well known to use a zipper with interlocking profiles at the mouth of a reclosable bag. It is further well known to use a slider mounted on the zipper profile whereby slider movement in a first direction opens the bag by releasing the profiles from each other and slider movement in a second direction closes the bag by interlocking the profiles to each other.

However, typically, such prior art sliders are operated by a user holding the bag with one hand and moving the slider with the other hand so that two hands are needed. This required use of two hands may be inconvenient, or even impossible, for some users.

OBJECTS AND SUMMARY OF THE INVENTION

It is therefore an object of this invention to provide a reclosable bag with a slider mounted on the zipper, wherein the zipper can be operated by the user with a single hand.

This and other objects are attained by providing a slider with a thumbwheel or similar rotary device journaled for rotation on an axis in the sidewall or top of the slider, wherein the thumbwheel impinges against the zipper profile. With this configuration, the user can hold the reclosable bag with a single hand and use the thumb of this hand to impart rotary motion to the thumbwheel or similar device thereby driving the slider in either an opening or closing direction. One further embodiment includes a ribbed track on the slider which engages the similarly ribbed surface of the thumbwheel to form a rack and pinion configuration. Another further embodiment uses a flexible band traveling in an elongated oval path as the thumbwheel.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENTS

Figure 1:
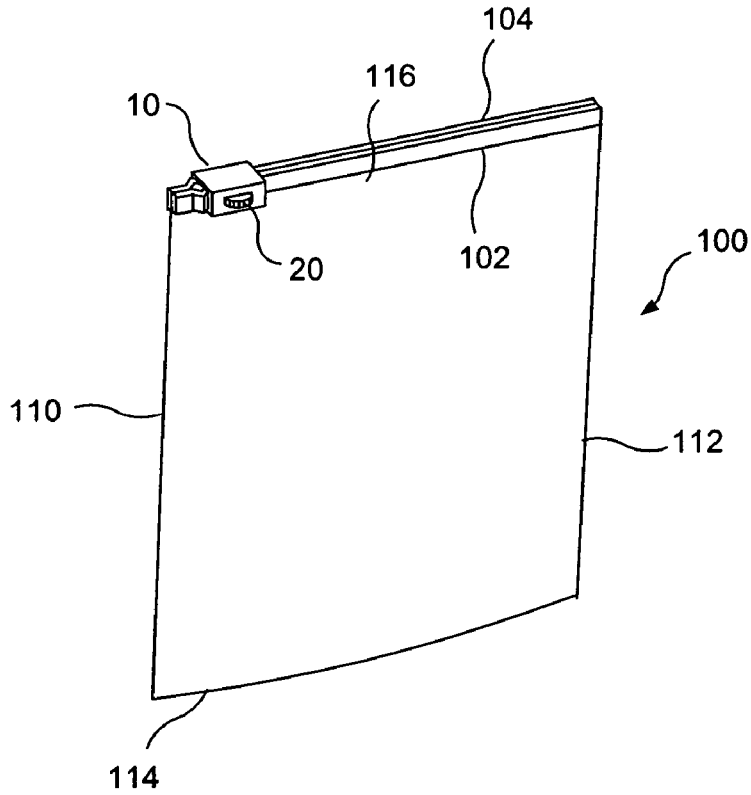
FIG. 1 is a perspective view of a reclosable bag, including a slider with a thumbwheel.

Referring now to the drawings in detail wherein like numerals refer to like elements throughout the several views, one sees that FIG. 1 is a perspective view of reclosable plastic bag 100 which incorporates the first embodiment of the interlocking profiles 102, 104 and slider 10. Reclosable plastic bag 100 is illustrated as two sheets of film material which are sealed at edges 110, 112, 114 so as to leave a mouth 116 which is selectively opened and closed by the interlocking profiles 102, 104. However, those skilled in the art will realize that there are many different structures of reclosable plastic bags and that the structure of the profiles 102, 104 and slider 10 can be incorporated therein.

Figure 2:
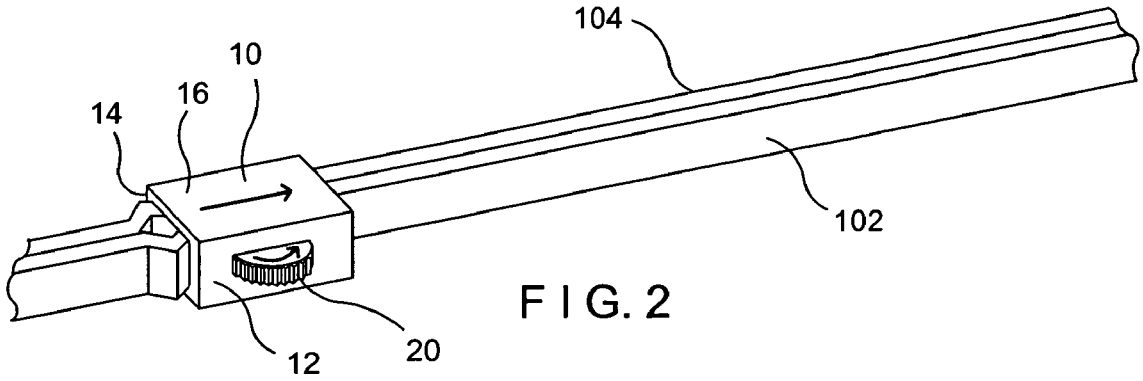
FIG. 2 is a perspective view of a first embodiment of the interlocking profiles and slider as shown in FIG. 1, wherein the thumbwheel is journaled for rotation on an axis in a sidewall of the slider.

As can be seen in more detail in FIG. 2, the first embodiment of slider 10 includes sidewalls 12, 14 which are joined by top 16. Slider 10 is mounted on interlocking profiles 102, 104 and includes internal structure such that movement in a first direction disengages the interlocking profiles 102, 104 from each other so as to open the mouth 116 of recloseable bag 100. Likewise, movement of slider 10 in a second direction engages the interlocking profiles 102, 104 to each other so as to close the mouth 116 of reclosable bag 100. Those skilled in the art will recognize that there are many configurations of interlocking profiles which function in this way, and that there are many internal structures of the slider 10 which function in this way.

Figure 4:
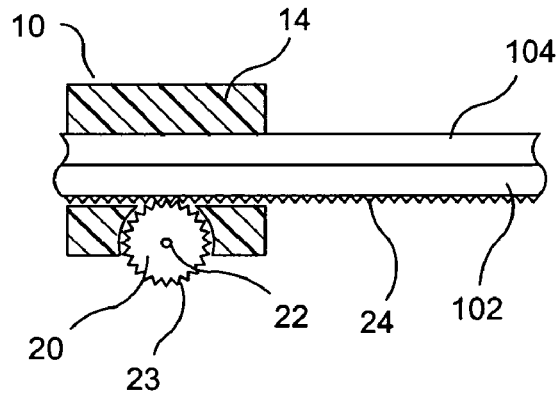
FIG. 4 is a cross-sectional view along plane 4-4 in FIG. 3.
Figure 3:
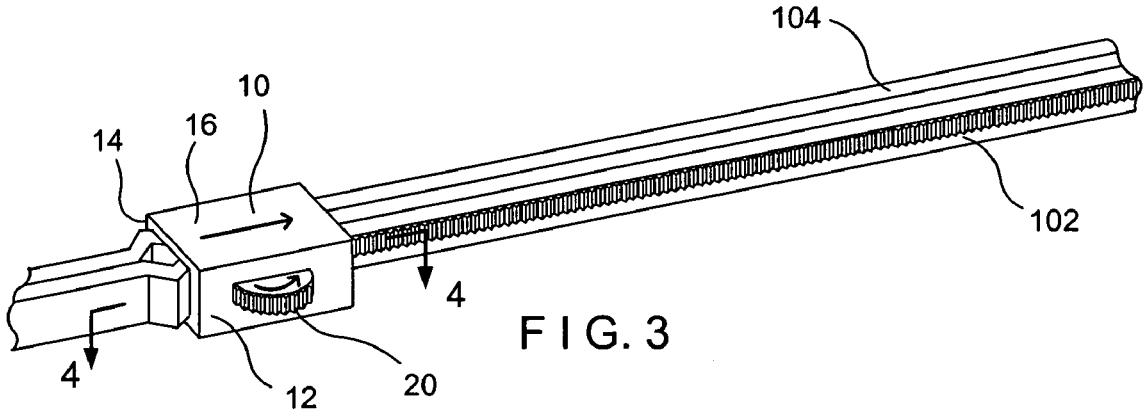
FIG. 3 is a perspective view of a second embodiment of the interlocking profiles and slider, wherein one of the profiles includes a ribbed track which forms a rack and pinion configuration with the thumbwheel which includes a similar surface.

As further seen in FIGS. 2, 3 and 4, thumbwheel 20 is journaled for rotation about axis 22 which is formed in sidewall 12 of slider 10. Thumbwheel 20 is configured so as to impinge against the exterior of profile 102 whereby rotation of thumbwheel 20, typically effected by the user's thumb, will cause a frictional force against profile 102 thereby causing linear motion of slider 10 across profiles 102, 104. Depending upon the direction of motion of slider 10, this will result in the disengagement or engagement of profiles 102, 104 thereby causing the respective opening or closing of the mouth 116 of reclosable bag 10. Typically, thumbwheel 20 includes a serrated, ribbed or gear-like periphery 23 in order to result in increased friction and more reliable operation. Furthermore, as shown in FIG. 3, in a second embodiment, profile 102 may include longitudinally-oriented ribbed track 24 which is positioned to engage the serrated, ribbed or gear-like periphery 23 of thumbwheel 20 thereby resulting in further increases in reliability in operation.

Figure 5:
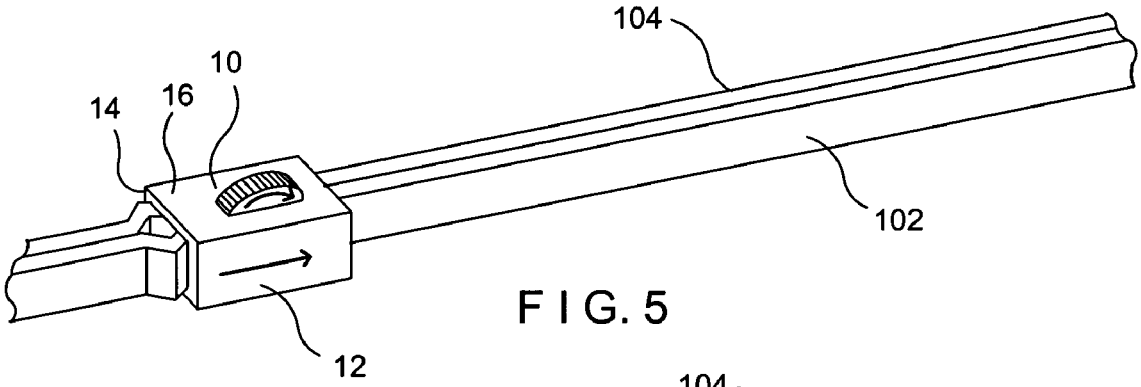
FIG. 5 is a perspective view of a third embodiment of the interlocking profiles and slider, wherein the thumbwheel is journaled for rotation on an axis in the top of the slider.

As shown in FIG. 5, in a third embodiment, thumbwheel 20 can likewise be journaled for rotation about an axis in the top 16 of slider 10, thereby impinging against one or both of interlocking profiles 102, 104.

Figure 7:
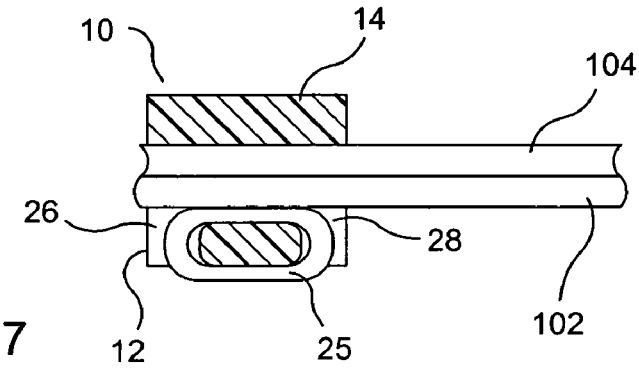
FIG. 7 is a cross-sectional view along plane 7-7 of FIG. 6.
Figure 6:
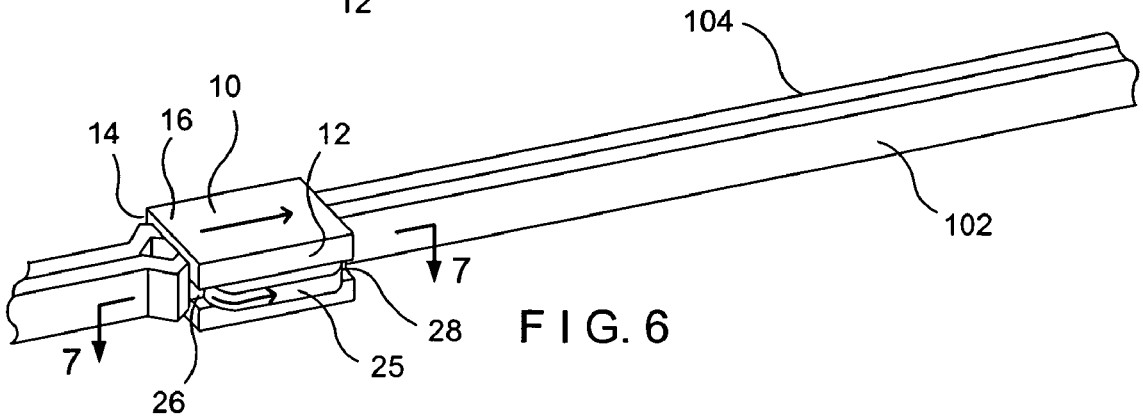
FIG. 6 is a perspective view of a fourth embodiment of the interlocking profiles and slider, wherein a flexible band traveling in a oval-like path is used as the thumbwheel.

As shown in FIGS. 6 and 7, in a fourth embodiment, flexible or elastic band 25 can be used as a thumbwheel. Band 25 may be textured or ribbed for better traction between the band 25 and the profile and between the band 25 and the user's finger or thumb. In this embodiment, slots 26, 28 are formed on the sidewall 12 of slider 10. Flexible or elastic band 25 passes through and is retained by slots 26, 28. Band 25 extends slightly from the exterior of sidewall 12 and likewise extends from the interior of sidewall 12 to impinge against profile 102. Typically, some tension is maintained on flexible or elastic band 25. The user can rotate band 25 with his or her thumb thereby urging band 25 against profile 102 thereby causing linear motion of slider 10 across profiles 102, 104. Depending upon the direction of motion of slider 10, this will result in the disengagement or engagement of profiles 102, 104 thereby causing the respective opening or closing of the mouth 116 of reclosable bag 100.

In summary, to use the slider 10 of the present device, the user typically holds the reclosable bag 100 with a single hand so that the user's thumb can contact the thumbwheel 20 or band 25. The user then urges rotary motion of the thumbwheel 20 or band 25 which causes linear motion of slider 10 across profiles 102, 104 thereby causing opening or closing of mouth 116 of reclosable bag 100.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A reclosable container including:

film material forming sides and a mouth, interlocking zipper profiles at said mouth, a slider mounted on said zipper profiles, whereby movement of said slider in a first direction disengages said interlocking zipper profiles from each other thereby opening said mouth and movement of said slider in a second direction engages said interlocking zipper profiles with each other thereby closing said mouth, said slider including a rotary device protruding from said slider for manually moving said slider across said interlocking zipper profiles;

wherein said rotary device is a thumbwheel which impinges against at least one of said zipper profiles, whereby movement of said thumbwheel causes movement of said slider:

wherein said slider includes a first sidewall joined to a second sidewall by a top, and wherein said thumbwheel is journaled for rotation about an axis in one of said sidewalls; and wherein said thumbwheel includes a ribbed periphery.

2. The reclosable container of claim 1 wherein one of said interlocking profiles includes a longitudinally oriented ribbed track which engages a portion of said fibbed periphery.

3. A reclosable container including:

film material forming sides and a mouth, interlocking zipper profiles at said mouth, a slider mounted on said zipper profiles, whereby movement of said slider in a first direction disengages said interlocking zipper profiles from each other thereby opening said mouth and movement of said slider in a second direction engages said interlocking zipper profiles with each other thereby closing said mouth, said slider including a rotary device protruding from said slider for manually moving said slider across said interlocking zipper profiles;

wherein said rotary device is a thumbwheel which impinges against at least one of said zipper profiles, whereby movement of said thumbwheel causes movement of said slider; and wherein said slider includes a first sidewall joined to a second sidewall by a top, and wherein said thumbwheel is journaled for rotation about an axis in said top.

4. A reclosable container including:

film material forming sides and a mouth, interlocking zipper profiles at said mouth, a slider mounted on said zipper profiles, whereby movement of said slider in a first direction disengages said interlocking zipper profiles from each other thereby opening said mouth and movement of said slider in a second direction engages said interlocking zipper profiles with each other thereby closing said mouth, said slider including a rotary device protruding from said slider for manually moving said slider across said interlocking zipper profiles; and wherein said slider includes a first sidewall joined to a second sidewall by a top, said first sidewall includes two slots on opposing ends thereof, and wherein said rotary device is a flexible band passing through and retained by said two slots.

5. A zipper configuration including:

interlocking zipper profiles, a slider mounted on said zipper profiles, whereby movement of said slider in a first direction disengages said interlocking zipper profiles from each other thereby opening said mouth and movement of said slider in a second direction engages said interlocking zipper profiles with each other thereby closing said mouth, said slider including a rotary device protruding from said slider for manually moving said slider across said interlocking zipper profiles;

wherein said rotary device is a thumbwheel which impinges against at least one of said zipper profiles, whereby movement of said thumbwheel causes movement of said slider;

wherein said slider includes a first sidewall joined to a second sidewall by a top, and wherein said thumbwheel is journaled for rotation about an axis in one of said sidewalls; and wherein said thumbwheel includes a ribbed periphery.

6. The zipper configuration of claim 5 wherein one of said interlocking profiles includes a longitudinally oriented ribbed track which engages a portion of said ribbed periphery.

7. A zipper configuration including:

interlocking zipper profiles, a slider mounted on said zipper profiles, whereby movement of said slider in a first direction disengages said interlocking zipper profiles from each other thereby opening said mouth and movement of said slider in a second direction engages said interlocking zipper profiles with each other thereby closing said mouth, said slider including a rotary device protruding from said slider for manually moving said slider across said interlocking zipper profiles;

wherein said slider includes a first sidewall joined to a second sidewall by a top, said first sidewall includes two slots on opposing ends thereof, and wherein said rotary device is a flexible band passing through and retained by said two slots.

8. A slider for mounting on zipper profiles, for engaging and disengaging the zipper profiles in response to movement of the slider, the slider including:

a first sidewall, a second sidewall, a top joining said first and second sidewalls, a rotary device protruding from said first sidewall for manually moving the slider across interlocking zipper profiles;

wherein said rotary device is a thumbwheel, whereby movement of said thumbwheel causes movement of said slider across interlocking zipper profiles;

wherein said thumbwheel is journaled for rotation about an axis in one of said sidewalls; and wherein said thumbwheel includes a ribbed periphery.

9. A slider for mounting on zipper profiles, for engaging and disengaging the zipper profiles in response to movement of the slider, the slider including:

a first sidewall, a second sidewall, a top joining said first and second sidewalls, a rotary device protruding from said first sidewall for manually moving the slider across interlocking zipper profiles; and wherein said first sidewall includes two slots on opposing ends thereof, and wherein said rotary device is a flexible band passing through and retained by said two slots.

* * * * *